United States Patent [19]

Purkapile

[11] Patent Number: 4,946,286

[45] Date of Patent: Aug. 7, 1990

[54] LIQUID PITCHER INCLUDING A MIXING AND GRINDING MECHANISM

[75] Inventor: Emerson J. Purkapile, Chicago, Ill.

[73] Assignee: The Coca-Cola Company, Atlanta, Ga.

[21] Appl. No.: 275,381

[22] Filed: Nov. 23, 1988

[51] Int. Cl.[5] ..... B01F 7/26

[52] U.S. Cl. ..... 366/247; 366/243; 366/277; 366/281; 366/289; 366/304; 366/306; 366/316; 366/317

[58] Field of Search ..... 366/242–253, 366/315–317, 302–306, 281–284, 129, 130, 277, 289; 241/199.12, 203, 205, 168, 169.1, 220, 261, 261.2, 261.3, 297, 98

[56] References Cited

U.S. PATENT DOCUMENTS

| | | | |
|---|---|---|---|
| 32,250 | 5/1861 | Jackson et al. | 366/304 |
| 1,670,593 | 5/1928 | Miller | 366/303 |
| 1,676,663 | 7/1928 | Nicholls | 241/261 |
| 1,798,757 | 3/1931 | Roberts | 366/242 |
| 2,517,149 | 8/1950 | Walsh et al. | 366/304 |
| 2,545,240 | 3/1951 | Patoe | 241/169 |
| 2,893,708 | 7/1959 | Penberthy et al. | 366/305 |
| 2,898,094 | 8/1959 | O'Neill, Jr. | 366/242 |
| 2,904,407 | 9/1959 | Rosenthal et al. | 366/317 |
| 2,984,462 | 5/1961 | O'Conner | 366/316 |
| 3,154,123 | 10/1964 | Tomlinson | 241/203 |
| 3,214,104 | 10/1965 | Breuninger et al. | 241/297 |
| 3,253,300 | 5/1966 | Gove et al. | 366/304 |
| 3,285,584 | 11/1966 | Goldfarb | 366/252 |
| 3,581,790 | 6/1971 | Conte | 241/169.1 |
| 3,603,563 | 9/1971 | Holland | 366/317 |
| 3,856,138 | 12/1974 | Maekawa et al. | 366/130 |
| 4,010,934 | 3/1977 | McCord et al. | 366/247 |
| 4,032,117 | 6/1977 | Burgess | 366/304 |
| 4,065,811 | 12/1977 | Pautz | 366/244 |
| 4,609,156 | 9/1986 | Bocle | 241/199.12 |
| 4,815,671 | 3/1989 | Akira | 241/199.12 |

FOREIGN PATENT DOCUMENTS

| | | | |
|---|---|---|---|
| 2500444 | 7/1975 | Fed. Rep. of Germany | 366/246 |
| 965122 | 9/1950 | France | 366/243 |
| 439553 | 4/1975 | U.S.S.R. | 241/261 |

*Primary Examiner*—Harvey C. Hornsby
*Assistant Examiner*—Joseph S. Machuga
*Attorney, Agent, or Firm*—Birch, Stewart, Kolasch & Birch

[57] ABSTRACT

A pitcher for grinding and mixing material therein including a pitcher body, a removable lid and a rotary and reciprocal shaft journaled in the lid and having an apertured grinding and mixing plate attached to one end of the shaft. The grinding and mixing plate includes a plurality of mixing holes, four equally spaced semicircular rim segments, and a set of grinding teeth located on the underside thereof facing a set of fixed grinding teeth located in a row on the bottom of the pitcher with the two sets of grinding teeth being mutually facing and interfitting. The mixer plate can be rotated to grind up frozen concentrate or reciprocated within the container to mix liquids therein. The holes in the aperture plate provide a mixing action in both the rotary and reciprocating modes of operation.

15 Claims, 3 Drawing Sheets

LIQUID PITCHER INCLUDING A MIXING AND GRINDING MECHANISM

FIELD OF THE INVENTION

1. Field of the Invention

This invention relates generally to a liquid pitcher and more particularly to a liquid pitcher having an integral mixer/stirrer assembly for mixing liquids directly in the pitcher.

2. Description of the Prior art

Juice pitchers including a manually operated rotary stirring mechanism are generally known. Such apparatus typically includes internal stirring means which is coupled to an external handle through a cap or lid member fitted to the open end of an elongated pitcher body which is generally circular in cross section. The stirrer can take many forms including various types of mixing plates and vanes which extend down into the liquid being mixed as a result of the rotary motion imparted thereto through action of the handle.

While such apparatus presumably operates as intended, the prior art is inherently limited in its inability to break up frozen or semi-solid materials such as frozen juice concentrate or a block of powdered milk which needs to be separated into smaller pieces prior to the addition of a liquid such as water or milk.

Accordingly, it is an object of the present invention to provide an improvement in liquid containers utilized for mixing and storing liquids.

It is a further object of the invention to provide an improvement in liquid containers utilized for preparing a liquid from a concentrate of a product being liquified.

A further object of the invention is to provide a liquid mixing container which additionallY is capable of breaking up or otherwise grinding a food concentrate prior to or during the addition of a liquid thereto.

And still a further object of the invention is to provide a juice container which is capable of breaking up and mixing frozen concentrated juice during the preparation of a frozen juice mix.

SUMMARY

Briefly, the foregoing and other objects of the invention are achieved by the combination of a rotary and reciprocal shaft journaled in a removable lid fitted to the top of a container body defining a pitcher and including an apertured mixing plate located within the pitcher body and attached to the end of the shaft. The plate has a plurality of holes therein and a set of grinding teeth located on the underside thereof facing a set of interfitting grinding teeth located on the bottom of the pitcher body. The mixer plate thus may be rotated to grind up frozen concentrate or reciprocated within the container to mix the liquids therein; however the holes in the mixing plate provide a mixing action in both the rotary and the reciprocating modes of operation.

BRIEF DESCRIPTION OF THE DRAWING

The present invention will be more readily understood when the following specification is read in conjunction with the drawings wherein.

DETAILED DESCRIPTION OF THE INVENTION

Figure 1:
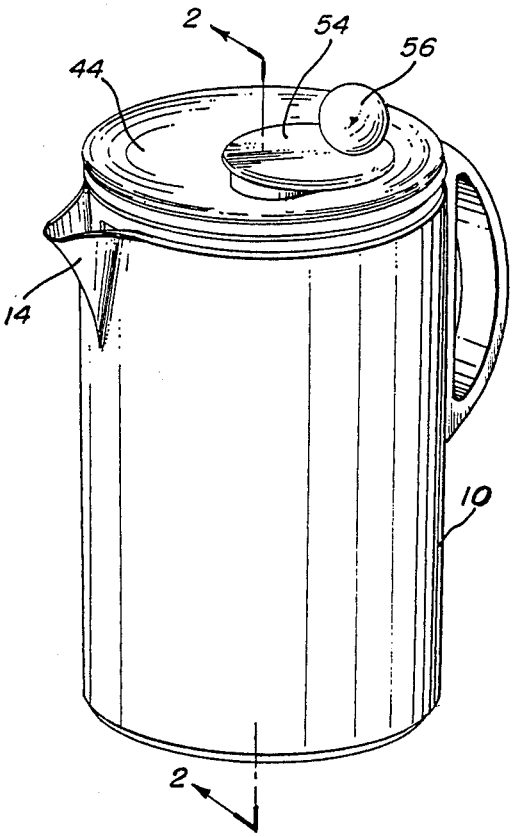
FIG. 1 is a perspective view generally illustrative of the Preferred embodiment of the invention.
Figure 2:
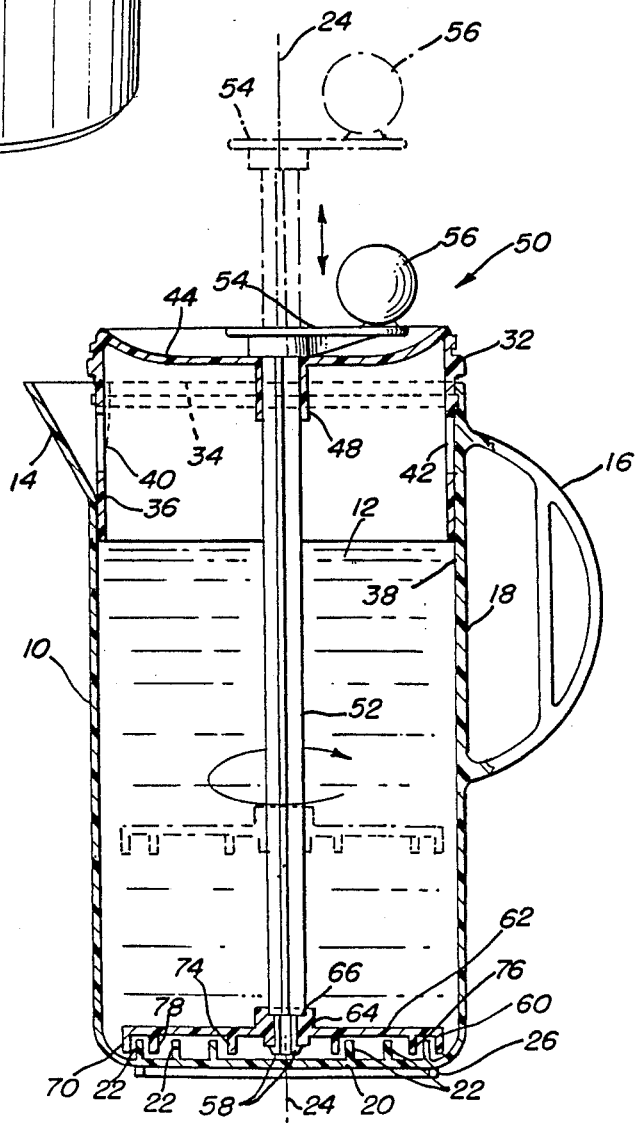
FIG. 2 is a central longitudinal cross sectional view of the invention taken along the lines 2—2 of FIG. 1.

Referring now to the drawings wherein like reference numerals refer to like parts throughout, reference numeral 10 in FIG. 1, for example, denotes an elongated container body of generally circular cross section defining a pitcher for mixing and holding a liquid, for example, a frozen juice concentrate to which has been added a predetermined quantity of water 12 as shown in FIG. 2. The pitcher body 10 includes an open end portion at the top which includes a pouring spout 14. A generally semicircular hand grip member 16 is formed on the outer surface 18 of the container body 10 opposite th pouring spout 14.

Figure 3:
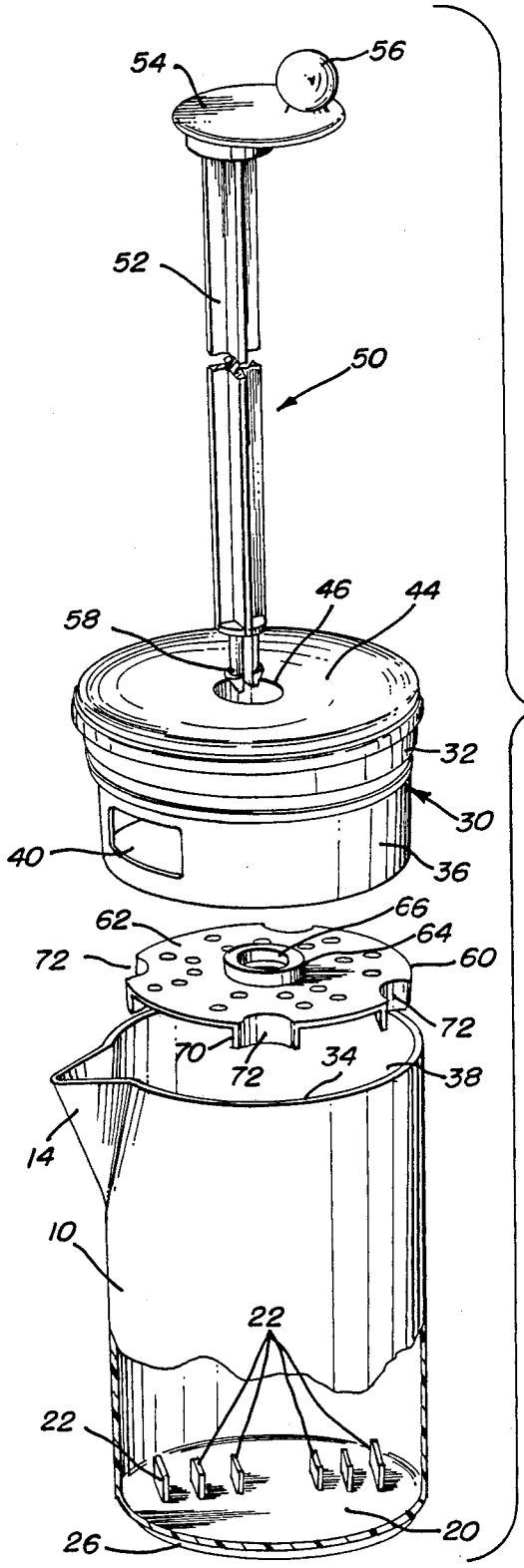
FIG. 3 is an exploded perspective view of the embodiment shown in FIGS. 1 and 2.

The container body 10, moreover, includes a closed end comprising a bottom wall 20 which includes a single row of six upwardly projecting teeth 22 arranged along a diameter of the circular cross section intersecting the spout 14 and hand grip 16 as shown in FIG. 3. Further as shown, the width of the teeth 22 become progressively longer as they are set back from the central longitudinal axis 24. A small circular base member 26 is formed on the outer surface of the bottom wall 20 for stability.

Figure 4:
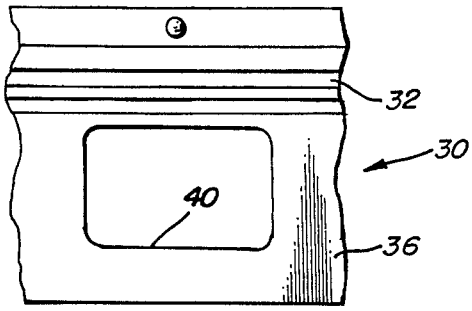
FIG. 4 is a partial sectional view of the lid illustrating one pouring opening therein.
Figure 5:
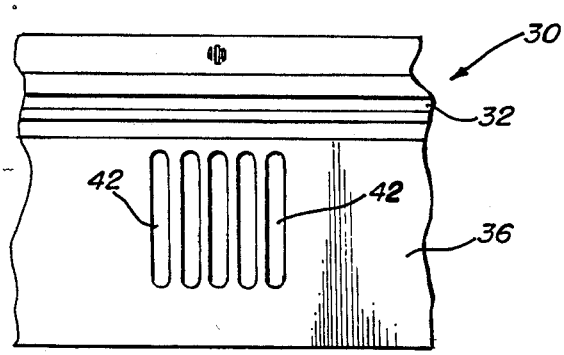
FIG. 5 is a partial sectional view of the lid illustrating another pouring opening therein.

A lid 30 of generally circular cross section and including an outwardly projecting side rim 32 is adapted to seat on the flat upper surface 34 of the pitcher body 10. The lid 30, moreover, includes a downwardly depending side wall 36 for engaging the upper portion of the inside wall surface 38 of the pitcher when in place on the pitcher body 10. The depending side wall 36, moreover, includes an unobstructed rectangular opening 40 as shown in FIG. 4 and an opening comprised of five vertical slots 42 for feeding liquid from the container when rotated in place in alignment with the spout 14. Such a construction is well known and can be found in various types of conventional juice pitchers. The lid 30, moreover, includes a slightly concave top wall 44, as best shown in FIG. 2, including a centralized aperture 46 (FIG. 3) which includes relatively short cylindrical section 48 directed inwardly for providing a journaled bearing surface for a hand crank 50 shown in FIGS. 2 and 3.

The hand crank 50 includes an elongated ribbed shaft 52 which is connected at one end to a lever arm 54 comprising an offset circular disk having a rounded knob 56 attached thereto which may be manually grasped. The shaft 52 is adapted to be inserted through the aperture 46 and the diameter of the disk member 54 is such that it resides within the confines of the shallow depression of the lid defined by the upper wall member 44 as shown in FIG. 2.

Figure 6:
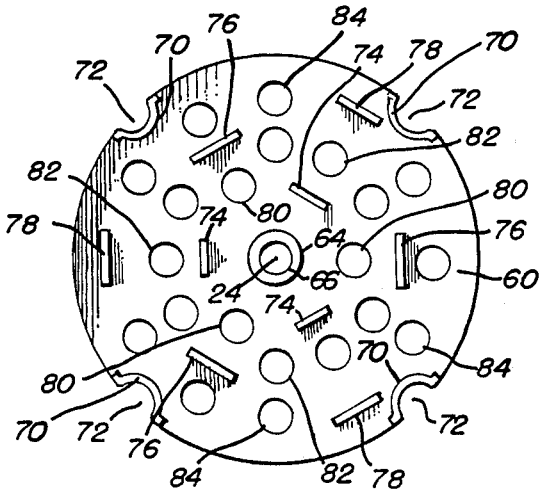
FIG. 6 is a bottom plan view illustrative of the grinding and mixing plate member shown in FIG. 3.

The opposite end of the crankshaft 52 terminates in a set of clips 58 which are utilized to attach to a grinding and mixing plate member 60 which is adapted to reside in the lower part of the pitcher body 10 when in use. The details of the grinding and mixing plate 60 are shown in FIGS. 2, 3 and 6. The plate 60 is comprised of a generally circular member having a flat upper surface 62 which terminates at the center in a hub 64 including a central opening 66 for engaging the end of the shaft 52 and the clips 58, respectively.

As shown in FIGS. 3 and 6, the plate 60 includes four semicircular recesses 72 formed in downwardly projecting rim segments 70 equidistantly apart around the edges. The grinding and mixing plate 60 further includes a set of downwardly projecting teeth comprised of three sub-sets of grinding teeth 74, 76 and 78, of three teeth each, arranged in concentric circles around the axis 24. Further as shown, each of the teeth 74, 76 and 78 in each circle are mutually separated from one another by 120° and are staggered 60° relative to its adjacent sub-set. Moreover, three concentric rings of circular mixing holes or openings 80, 82 and 84 are formed in the plate member 60 and are spaced between the three sub-sets of grinding teeth 74, 76 and 78. When the grinding and mixing plate 60 is in place within the pitcher body 10 and rotated by means of the hand crank 50, the three sub-sets of grinding teeth 74, 76 and 78 on the lower surface portion of the plate 60 face and rotate between the fixed row of grinding teeth 22 projecting upwardly from the bottom portion 20 of the pitcher body 10.

It can be seen by reference to FIG. 2 that a rotary motion of the hand crank 50 provides a grinding and stirring operation on material placed between the fixed set of teeth 22 and rotatable set of teeth 74, 76 and 78, while a reciprocatory or plunging motion provided by a raising and lowering of the crank 50 through the lid 30 provides a mixing operation on the material; however, it should also be noted that a mixing operation is also effected in the rotary mode of operation where any solid material has become either liquified or reduced to a slurry.

Such an arrangement is particularly useful in a pitcher for mixing frozen juice concentrate where the solidified concentrate can be broken up and ground by action of the toothed arrangement provided on the bottom of the mixing plate 60 and the bottom surface of the container. Following the addition of a predetermined quantity of water, the combination can be reduced to a consumable mixture by either rotating or reciprocating the crank.

Having thus shown and described what is at present considered to be the preferred embodiment of the invention, it should be noted that the same has been made by way of illustration and not limitation. Accordingly, all alterations, modifications and changes coming within the spirit and scope of the invention as set forth in the appended claims are meant to be included.

I claim:

1. A container for breaking up and mixing material including a frozen juice concentrate, comprising:

a container body open at one end and closed at the other end;

a removable lid fitted to the open end of the container body, said lid further including a journaled aperture for supporting a crank member;

a crank member capable of both rotary and a reciprocatory motion extending through said aperture and including a lever arm member, a handle, and an elongated shaft having one end attached to the lever arm member;

a grinding and mixing plate attached to the other end of the elongated shaft and including a plurality of mixing openings therein and a lower surface portion facing the closed end of the container body and having a first set of grinding teeth arranged in concentric circles around a central axis of said container body and a plurality of curvilinear rim segments projecting toward said closed end of said container body; and a second set of grinding teeth located on said closed end of said container body, directed toward and intermeshing with said first set of grinding teeth for acting in concert therewith to grind material placed in the container body, whereby rotary motion of the crank member provides a unitary grinding and stirring operation on said material while reciprocatory motion thereof provides a mixing operation on said material.

2. The container as defined in claim 1 and wherein said plurality of mixing openings are selectively dispersed between said first set of teeth.

3. The container as defined by claim 1 wherein said plurality of openings in said mixing plate are arranged in concentric circles on the lower surface portion of said mixing plate.

4. The container as defined by claim 1 wherein said second set of teeth comprises at least one row of teeth projecting toward said grinding and mixing plates from said closed end of the container body.

5. The container as defined by claim 4 wherein said at least one row of teeth of said second set of teeth passes through said central axis of the container body.

6. The container as defined in claim 1 wherein said plurality of mixing openings comprise holes dispersed between said first set of teeth.

7. The container as defined in claim 6 wherein said mixing holes are arranged in concentric circles around said central axis.

8. The container as defined in claim 1 wherein said rim segments comprise four equally spaced segments of semicircular configuration.

9. A container for breaking up and mixing material including a frozen juice concentrate, comprising:

a container body open at one end and closed a the other end;

a removable lid fitted to the open end of the container body, said lid further including a journaled aperture for supporting a crank member;

a crank member capable of both rotary and a reciprocatory motion extending through said aperture and including a lever arm member, a handle, and an elongated shaft having one end attached to the lever arm member;

a grinding and mixing plate attached to the other end of the elongated shaft and including a plurality of mixing openings therein, a lower surface portion facing the closed end of the container body and having a first set of grinding teeth and a plurality of curvilinear rim segments projecting toward said closed end of said container body; and a second set of grinding teeth located on an inner surface of said closed end of said container body and intermeshing with said first set of grinding teeth and acting in concert therewith for grinding material placed in the container body, whereby rotary motion of the crank member provides a unitary grinding and stirring operation on said material while reciprocatory motion thereof provides a mixing operation on said material.

10. The container as defined in claim 9 wherein said plurality of mixing openings are selectively dispersed between said first set of teeth.

11. The container as defined by claim 9 wherein said first set of teeth comprise at least one subset of teeth centrally located in a generally circular configuration on the lower portion of said mixing plate.

12. The container as defined by claim 9 wherein said first set of teeth comprise a plurality of teeth arranged in circular subsets on the lower surface portion of said mixing plate.

13. The container as defined by claim 9 wherein said second set of teeth comprises a set of teeth arranged in a row on the inner surface of said closed end of said container body.

14. The container as defined by claim 9 wherein said plurality of mixing openings comprise holes dispersed between said first set of teeth.

15. The container as defined by claim 9 wherein said rim segments comprise a plurality of equally spaced segments of semicircular configuration.

* * * * *